US006390029B2

(12) United States Patent
Alphs

(10) Patent No.: US 6,390,029 B2
(45) **Date of Patent: *May 21, 2002**

(54) WATER HEATER WITH SEDIMENT AGITATING INLET

(75) Inventor: Kevin J. Alphs, Madison, WI (US)

(73) Assignee: Bock Corporation, Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/826,766

(22) Filed: Apr. 5, 2001

Related U.S. Application Data

(63) Continuation of application No. 09/578,165, filed on May 22, 2000.

(51) Int. Cl.[7] ..... F22B 37/34

(52) U.S. Cl. ..... 122/380; 122/390; 16/2.2; 29/81.01

(58) Field of Search ..... 122/235.29, 379, 122/380, 382, 383, 390, 392; 16/2.2, 2.4; 29/81.01, 237

(56) References Cited

U.S. PATENT DOCUMENTS

| | | | | |
|---|---|---|---|---|
| 2,137,313 A | * | 11/1938 | Tingle et al. | 16/2.2 |
| 4,505,231 A | | 3/1985 | Syler | |
| 4,512,289 A | | 4/1985 | Collins | |
| 4,566,406 A | | 1/1986 | Appleman | |
| 4,714,053 A | | 12/1987 | Perry | |
| 4,790,289 A | | 12/1988 | Barrett | |
| 4,790,291 A | | 12/1988 | Barrett | |
| 4,804,212 A | * | 2/1989 | Vyse | 29/237 |
| 4,838,211 A | | 6/1989 | Vago | |
| 4,898,124 A | | 2/1990 | Granberg et al. | |
| 5,152,843 A | | 10/1992 | McDonald et al. | |
| 5,341,770 A | | 8/1994 | Lannes | |
| 5,348,037 A | * | 9/1994 | Katchka | 122/13.01 |
| 5,365,891 A | | 11/1994 | Hanning | |
| 5,564,371 A | | 10/1996 | Ashton et al. | |
| 5,609,124 A | | 3/1997 | Leclerc | |
| B15,341,770 A | | 9/1998 | Lannes | |
| 5,943,984 A | | 8/1999 | Lannes | |

OTHER PUBLICATIONS

"Oil–Fired Water Heaters Residential–Commercial"—Bock Water Heaters—Jan. 2000.

"Residential Oil–Fired Water Heaters: The Invisible Luxury: Hot Water on demand!"—Bock Water Heaters—Apr. 2000.

Bock Water Heaters Cglass® Lined Oil Water Heaters: wherever dependability is required.—Bock Water Heaters—Mar., 1996.

"Gas Water Heaters: Large Homes—Commercial Applications"—Bock Water Heaters—Feb., 2000.

http://www.waterheaterrescue.com/whr4.htm—Apr. 21, 2000.

* cited by examiner

*Primary Examiner*—Gregory Wilson
(74) *Attorney, Agent, or Firm*—Lathrop & Clark LLP

(57) ABSTRACT

A water heater has a cold water inlet bushing which screws into a threaded boss in the side wall of a hot water tank near its bottom. Cold water is injected through a pipe into the inlet bushing. A blind passageway is formed within the inlet bushing which extends radially inwardly from the tank outer wall. An outlet port intersects the blind passageway at 90 degrees, and is positioned tangent to the circular outer wall of the hot water tank at the point the tank is penetrated by the inlet bushing. The inlet bushing creates a jet of water which results in the water within the tank rotating. When turbulent mixing and circulation are created by the inlet water jet, smaller particles of sediment which are placed into suspension can be removed from the hot water tank along with the hot water. A drain is positioned next to and slightly below the inlet bushing so that when the water tank is drained, water from the inlet bushing will circulate almost completely around the inside of the tank bottom before reaching the outlet, thus driving sediments toward the outlet where they are removed.

6 Claims, 3 Drawing Sheets

WATER HEATER WITH SEDIMENT AGITATING INLET

CROSS REFERENCES TO RELATED APPLICATIONS

This application is a continuation of U.S. application Ser. No. 09/578,165 filed on May 22, 2000, the disclosure of which is incorporated by reference herein.

STATEMENT AS TO RIGHTS TO INVENTIONS MADE UNDER FEDERALLY SPONSORED RESEARCH AND DEVELOPMENT

Not applicable

BACKGROUND OF THE INVENTION

The present invention relates to water heaters and boilers in general, and in particular to water heaters and boilers which incorporate sediment agitating apparatus.

Water heaters are widely used in both domestic and industrial settings. Hot water is used in many cleaning applications from dishwashers to clothes washer to showers. Hot water is also used to control the temperature of many industrial processes, and for space heating within homes and factories. Hot water is also has important recreational uses in pools, spas, and hot tubs. However, water as typically found in industrial and domestic settings is not a pure substance, and contains to varying degrees dissolved and suspended minerals. As a result, it is often recommended that water heaters be cleaned or flushed out periodically to remove sediments that tend to accumulate within the water heater tank, particularly on the bottom of the tank.

The sediments which accumulate within water heaters have many sources. Sand and silt often accompany water obtained from wells, and even where water is supplied through city mains. Particles of rust and other debris may be entrained in well water or water supplied from city mains. Various chemical processes may result in the precipitation of particles within the hot water tank. Certain forms of water hardness, including lime scale, may be precipitated when the water is heated. Change in temperature and/or the availability of oxygen can result of the precipitation of minerals such as iron. The typical hot water tank can be an ideal system for precipitating these various contaminants because of the long periods of quiescence where little or no mixing occurs within the tank.

The effects of minerals precipitating and accumulating on to the bottom of a hot water tank are highly undesirable, particularly if the water within the tank is heated by an oil or gas flame. The accumulation of sediments on the bottom of the tank reduces water heater efficiency by reducing heat transfer. More serious than the mere loss of water heater efficiency is the greater temperature gradient which results because the sediments insulate the water heater bottom from the water contained within the tank. Because of the insulating effect of sediments within the tank, a larger thermal gradient is necessary to transfer heat through the tank bottom and the insulating layer of sediments. Because the water within the tank is insulated from the tank bottom, combustion gases are able to raise the tank bottom material to a higher temperature than would otherwise be the case. This higher temperature results in greater thermal expansion of the tank bottom and greater thermal cycling. If the temperature of the tank bottom is raised to a sufficiently high temperature, the material properties of the steel used to form the tank bottom can be altered so as to reduce strength and durability. Increasing the temperature of the tank bottom leads to the breakdown of the protective glass lining of the water heater. Thus the insulating effect of sediments which build up on the bottom of the water tank produces increased thermal cycling and loss of material properties, break down in the glass protective coating, and sometimes in aerobic bacteria, which can contribute to tank corrosion. These factors can eventually lead to leaking of the water tank, which requires replacement of the water heater.

What is needed is a water heater with active means for preventing the buildup of sediments on the bottom of the water tank.

SUMMARY OF THE INVENTION

The water heater of this invention has a cold water inlet which is located near the bottom of the water heater tank. Cold water is injected through an inlet bushing which screws into a threaded boss in the side wall of the hot water tank. A female pipe thread on the inside of the cold water inlet bushing accepts a ¾ inch male threaded pipe through which cold water is supplied to the water heater. A three-quarter inch diameter blind passageway is formed within the inlet bushing which extends radially inwardly from the tank outer wall. A outlet port with a diameter of ½ inch intersects the blind passageway at 90 degrees. The ½ inch diameter outlet port is positioned to discharge water within the tank along a line parallel to a tangent to the circular outer wall of the tank at the point the tank is penetrated by the inlet bushing. The inlet bushing accelerates the jet of water by creating a hydraulic pressure drop. The pressure is converted into velocity, and momentum transfer between the high velocity jet and the water contained in the tank results in the water within the tank rotating. The jet produces turbulent mixing between the injected water in the water contained within the tank.

The jet of cold water is only introduced into the tank when hot water is being drained from the hot water outlet, hence the turbulent mixing and circulation created by the inlet water jet places smaller particles of sediment into suspension which can be removed from the tank along with the hot water.

A drain is positioned next to and slightly below the inlet bushing so that when the water tank is drained, water from the inlet bushing circulates almost completely around the inside of the tank bottom before reaching the outlet, thus driving sediments toward the outlet for removal.

It is an object of the present invention to provide a hot water heater with longer service life.

It is another object of the present invention to provide a water heater that prevents the build up of sediments on the bottom of the tank.

It is a further object of the present invention to provide a water heater which provides for continuous flushing of sediments from within the tank.

It is also an object of the present invention to provide a water heater which better retains thermal efficiency over its operating life.

Further objects, features and advantages of the invention will be apparent from the following detailed description when taken in conjunction with the accompanying drawings.

DESCRIPTION OF THE PREFERRED EMBODIMENTS

Figure 1:
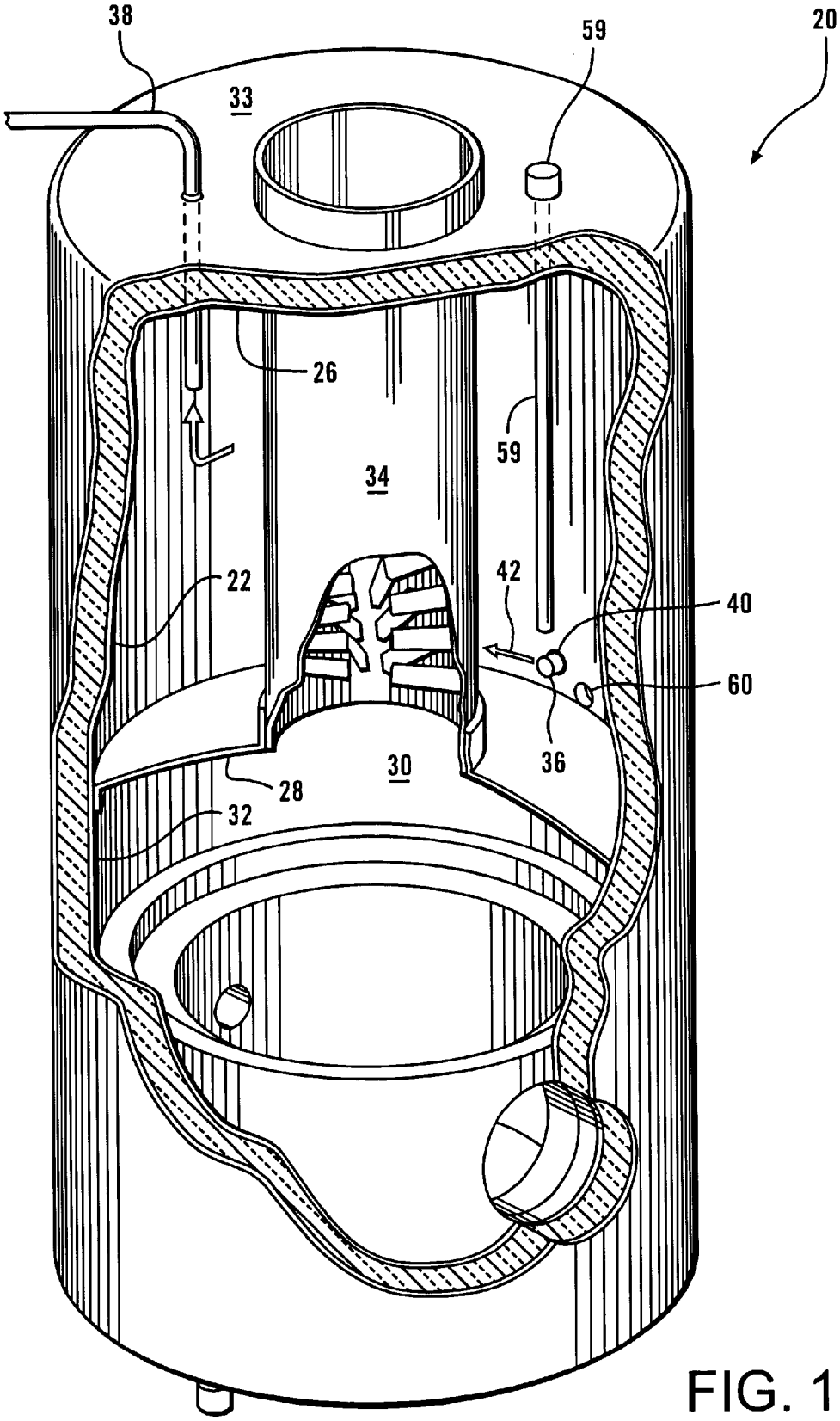
FIG. 1 is an isometric view, partially cut-away in section of a typical water heater showing placement of the inlet bushing of this invention.

Referring more particularly to FIGS. 1–5 wherein like numbers refer to similar parts, a water heater 20 is shown in FIG. 1. The water heater 20 has a water tank 22 formed by a cylindrical steel wall 24 which terminates at an upper dome 26. The water tank 22 cylindrical wall 24 extends downwardly past a bottom dome 28 to form a cylindrical sleeve 30 which defines a firebox 32. The cylindrical wall, as shown in FIG. 1, may be conventionally have a outer cover 33 with insulation between the cover 33 and the tank 22. An exhaust stack 34 extends from the firebox 32, beginning at the bottom dome 28 and extending upwardly through the upper dome 26. An oil or gas fire is produced within the fire box 32 so that the hot gases produced transfer heat to the water within the tank 22. Heat is transferred to the water in the tank through the bottom dome 28 and the sides of the upwardly extending stack 34. The water tank 22 has a cold water inlet 36 located near the bottom dome 28 and a hot water outlet 38 located in the upper dome 26.

Figure 2:
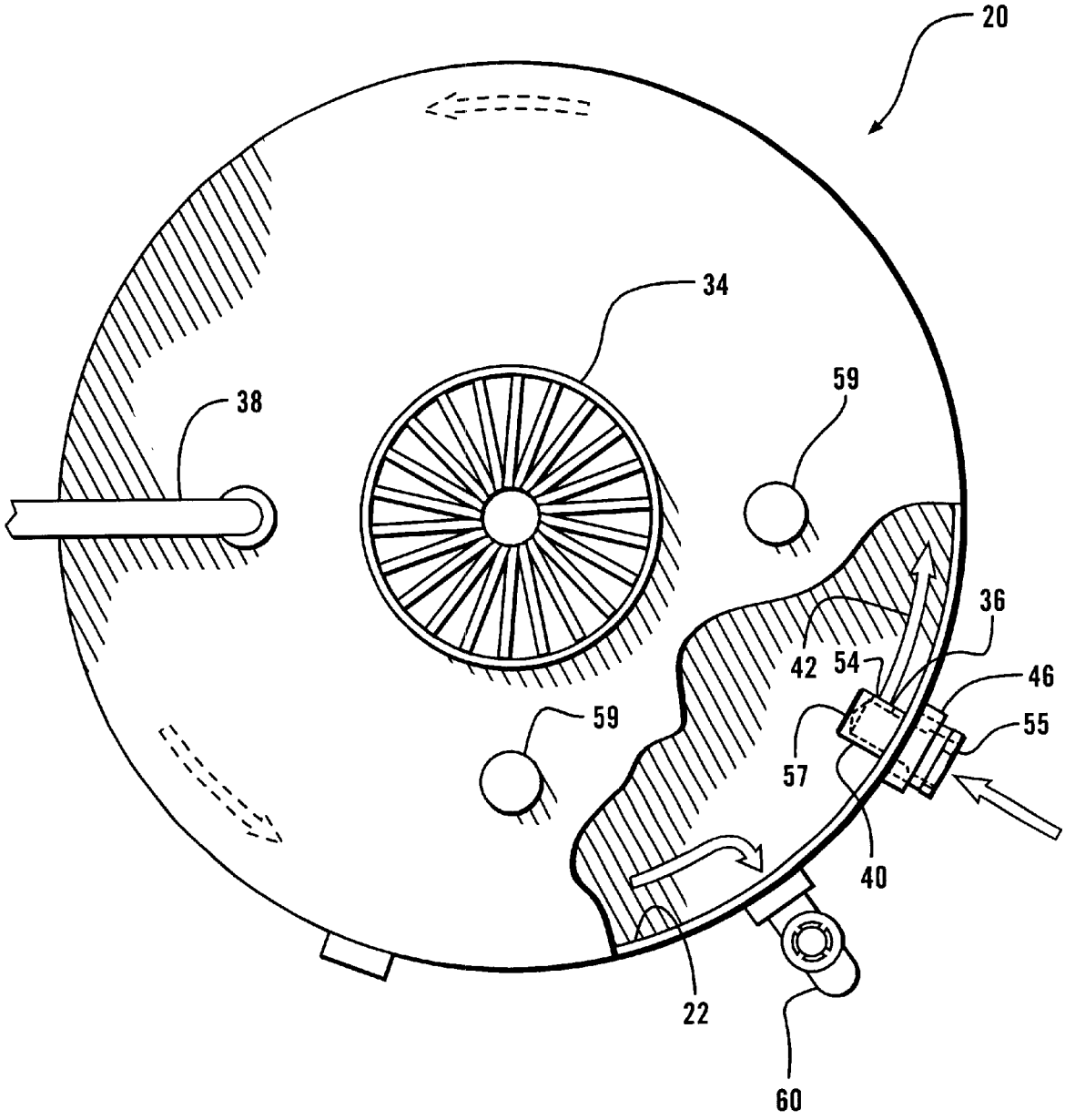
FIG. 2 is a top plan view partially cut-away of the water heater of FIG. 1, with the outer covering and insulation removed for clarity.
Figure 3:
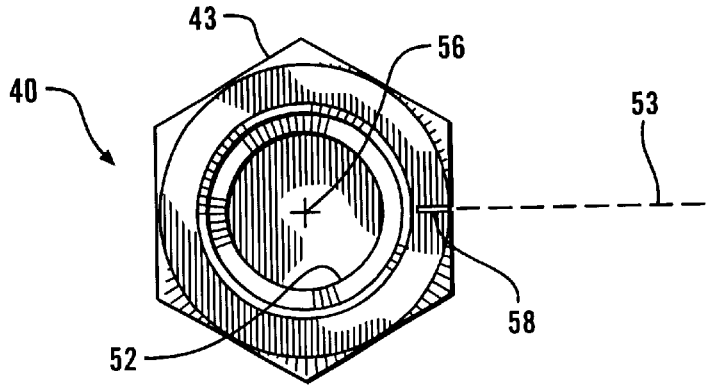
FIG. 3 is an end view of the inlet bushing of this invention.
Figure 4:
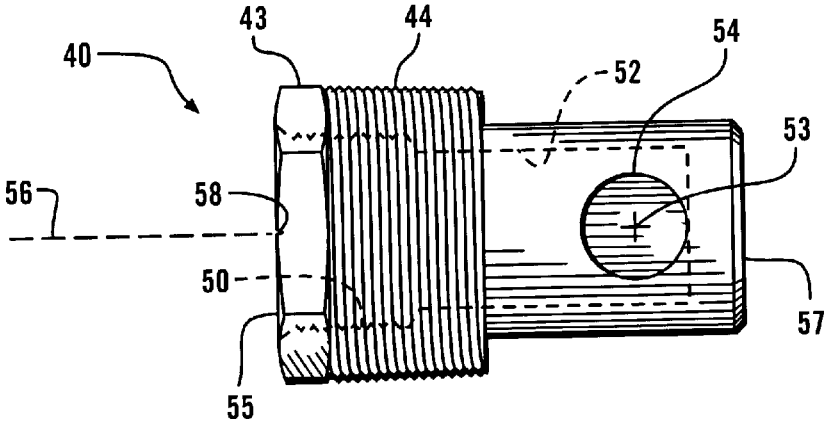
FIG. 4 is a side elevational view of the inlet bushing of FIG. 3.
Figure 5:
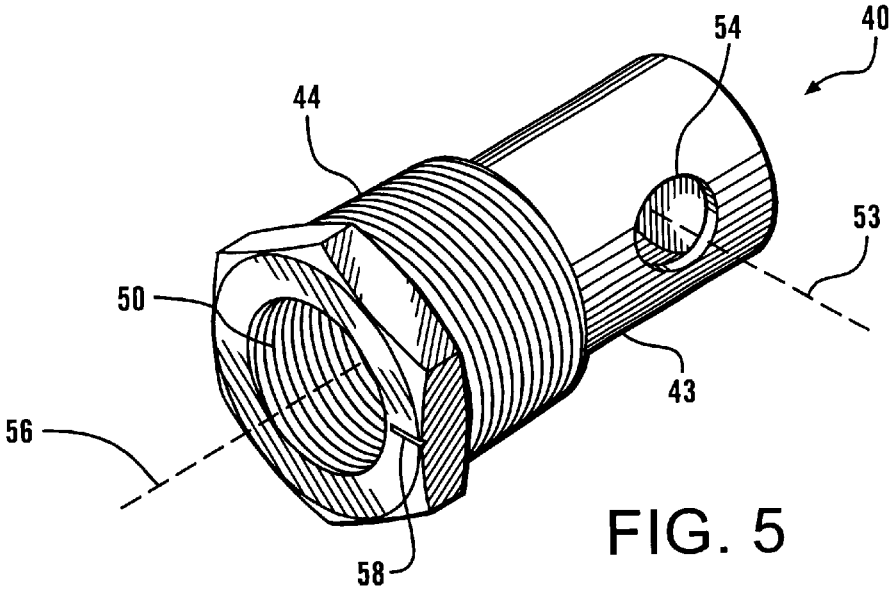
FIG. 5 is an isometric view of the inlet bushing of FIG. 3.

A cold water injection bushing 40, best shown in FIGS. 3–5, produces a jet of water indicated by arrow 42, as shown in FIGS. 1–2. The jet produces a swirling action when the hot water is withdrawn from the tank. As hot water leaves the tank, cold replacement water enters through the inlet bushing 40, as shown in FIG. 2.

Water is sometimes referred to as the universal solvent because of the large number of substances which can be dissolved by water to a greater or lesser extent. The water which finds its way into the typical home or industrial setting usually comes from a well or a surface water source, such as a lake or river. Water moving through underground aquifers or draining from the surface of the earth into a lake or river, typically becomes more or less saturated with the various minerals which it encounters. Most water contains one or more of the common ions such as calcium, magnesium, iron, and sulfur. The ions, particularly calcium and iron come out of solution, and deposit scale on the bottom of the water heater tank. The scale build-up insulates the tank bottom from the water within the tank. The flame of the burner produces hot gases which flow over the lower surface of the bottom of the tank and up the exhaust stack. When the tank bottom is insulated from the water within the tank, the hot gases can overheat the tank bottom, resulting in a detrimental effect to the glass lining which protects the inside of a hot water tank, and to the material properties of the bottom.

The problem of sediment buildup is aggravated in a typical hot water tank where cold water is injected through a dip tube which causes water to impinge locally on the tank bottom thereby resulting in uneven buildup of scale on the tank bottom.

Sediment build-up problems on the bottom of a water tank are reduced by the bushing 40 which injects the cold water tangential to the tank wall. The cold water injection bushing 40 has a body 43 which has an external 1¼ inch male thread 44 which screws into a receiving bushing 46 which is welded to the side of the water tank 22. A six sided 1⅜ inch nut 48 protrudes outwardly from the cold water injection bushing 40, providing engagement of the bushing 40 for screwing into the receiving bushing 46 on the side of the hot water tank 22. The cold water injection bushing 40 has an internal female one inch thread 50 which is axially aligned with the external thread 44, and which receives a one inch cold water inlet pipe (not shown). As shown in FIG. 4, a three-quarter inch diameter blind bore 52 extends into the body 43 of the bushing 40, and is axially aligned with the female thread 50. A one-half inch diameter outlet 54 intersects the blind bore 52 at ninety degrees to the axis 56 about which the bore 52 and the threads 44, 50 are centered. The axis 56 is perpendicular to a line tangent to the cylindrical tank wall at the point of intersection between the cylindrical wall and the axis 56. The axis 53 of the outlet 54 passes through the axis 56. As shown in FIG. 5, an index mark 58 is formed on the nut 48 and is aligned with the axis 53 of the outlet 54. The index mark 58 allows the inlet bushing 40 to be turned so that the axis 53 of the outlet 54 is aligned tangential to the wall 24 of the water tank 22.

The total length, from the inlet end 55, to the outlet end 57 along the axis 56 of the bushing 40 is about 2¼ inches. As shown in FIG. 4, the center of the outlet 54 is spaced about one inch from the inside wall of the water tank 22. The cold water injection bushing 40 is spaced above the bottom dome 28 a sufficient amount so that the body 43 of the bushing 40 does not contact the bottom dome 28 which curves gently upwardly towards the exhaust stack 34.

The cold water injection bushing 40 operates in at least three ways to extend the life of the water heater 20. First, by stirring the water, a certain amount of particulate matter leaves with the hot water through the hot water outlet 38 at the top of the tank. Second, by stirring the larger flakes of scale, the bottom of the tank is scoured and a build-up of a thick crust of scale is prevented. Immobilized scale can create anaerobic conditions, and the growth of anaerobic bacteria can detrimentally result in the corrosion of the bottom dome 28 of the water tank 22. The buildup of a thick crust of scale is more detrimental to heat transfer then loose scale which may form in the presence of circulation induced by the injection bushing 40. Build up of scale can also interfere with the galvanic protection provided by a sacrificial magnesium anode 59 further increasing the likelihood that the bottom dome 28 will corrode and thus eventually leak.

Third, the bushing functions in combination with a tank drain 60 which is positioned next to the injection bushing 40 but on the side facing away from the outlet 54. The tank drain 60 is positioned adjacent to the bottom dome 28 and has a large clear opening through which scale can be flushed. When the tank drain is opened the jet of water formed by the outlet 54 will scour the bottom 28, pushing scale towards the tank drain 60.

The bushing 40 may be formed as an inexpensive screw machine part manufactured from hexagonal brass bar stock. It should be understood, however, that the bushing 40 might be manufactured by casting or injection molding, and might be manufactured from plastic or metals other than brass.

It should be understood the all or substantially all the water entering the tank passes through the single outlet 54 to produce the jet of water, aimed along a single direction, which directs water around the bottom 28 of the tank 22.

It should be understood that the bushing 40 should be located as close as practical to the bottom dome 28 of the water heater tank 22. Because of the upwardly curving bottom dome 28 the bushing 40 must be spaced sufficiently above dome 28 so that the bushing 40 does not contact the dome as it protrudes into the tank 22.

Although the inlet bushing 40 may be used with a large variety of water heaters it may be particularly advantageous to be used with that type of water heater which has improved heat transfer in the stack 34 such as described in U.S. Pat. No. 5,924,390, and U.S. Pat. No. 4,239,953 which are incorporated herein by reference.

It is understood that the invention is not limited to the particular construction and arrangement of parts herein illustrated and described, but embraces such modified forms thereof as come within the scope of the following claims.

I claim:

1. A water heater comprising:

a water tank, the tank having a cylindrical wall, an upper dome, a lower dome, and defining an interior tank volume between said cylindrical wall, upper dome, and lower dome;

a cold water inlet positioned near the lower dome; wherein the cold water inlet comprises an elongated body, having a first end which extends into the interior tank volume, and a second end which remains outside the water tank and is affixed to the tank, portions of the inlet body defining a blind bore which extends inwardly from the second end towards the first end;

portions of the body defining an opening extending between the blind bore and the interior tank volume;

an index mark on the second end, which remains outside the water tank, the index mark aligned with the opening extending between the blind bore and the interior tank volume, so that the position of the opening can be visually aligned from the exterior of the water tank, the opening creating a fluid jet resulting in turbulence amongst sediment within the water heater tank.

2. The water heater of claim 1 further comprising a drain positioned at a location where the lower dome meets the tank wall, adjacent to the cold water inlet at a side of the body opposite the opening extending between the blind bore and the interior tank volume.

3. A water heater comprising:

a water heater tank, the tank having a cylindrical wall, an upper dome, a lower dome, and defining an interior tank volume between the cylindrical wall, the upper dome and the lower dome;

a cold water inlet positioned near the lower dome; wherein the cold water inlet comprises an elongated body, having a first end which extends a short distance into the tank volume, and a second end which remains outside the water tank, portions of the inlet body defining a blind bore which extends inwardly from the first end towards the second end;

portions of the body forming an opening extending between the blind bore and the interior tank volume so that substantially all the water entering the tank passes through the opening to produce a jet of water, aimed along a single direction, which directs water around the bottom of the tank; and a drain positioned at a location where the lower dome meets the tank wall, closely spaced from the cold water inlet at a side of the body opposite the opening extending between the blind bore and the interior tank volume.

4. The water heater of claim 3 further comprising an index mark on the second end, the index mark aligned so that the position of the opening can be visually aligned by means of the index mark.

5. A water heater comprising:

a water heater tank, the tank having a cylindrical wall, an upper dome, a lower dome, and defining an interior tank volume between the cylindrical wall, the upper dome and the lower dome;

a cold water inlet positioned near the lower dome, wherein the cold water inlet comprises an elongated body, having a first end which extends from the cylindrical wall a short distance into the tank volume, and a second end which remains outside the water tank, portions of the inlet body defining a blind bore which extends inwardly from the first end towards the second end;

portions of the body forming an opening extending between the bore and the interior tank volume, the opening directing water so that substantially all the water entering the tank passes through the opening to produce a jet of water, aimed along a single direction, which directs water around the bottom of the tank.

6. The water heater of claim 5 further comprising an index mark on the second end, the index mark aligned with the opening so the opening can be visually aligned by means of the index mark.

* * * * *